United States Patent [19]

Churchill

[11] Patent Number: 4,965,436

[45] Date of Patent: Oct. 23, 1990

[54] HEATER UNIT

[75] Inventor: John W. Churchill, Beverly, Mass.

[73] Assignee: Southport Enterprises, Beverly, Mass.

[21] Appl. No.: 803,524

[22] Filed: Dec. 2, 1985

Related U.S. Application Data

[63] Continuation of Ser. No. 301,134, Sep. 11, 1981, abandoned, which is a continuation of Ser. No. 513,140, Oct. 8, 1974, Pat. No. 4,349,727, which is a continuation-in-part of Ser. No. 382,295, Jul. 25, 1973, Pat. No. 3,482,099.

[51] Int. Cl.[5] ..... H05B 3/44

[52] U.S. Cl. ..... 219/544

[58] Field of Search ..... 219/209, 315, 316, 325, 219/331, 437, 438, 494, 504, 505, 510, 513, 523, 534, 535, 541, 544, 552; 338/217, 218, 239, 240, 241, 242, 338, 273, 274; 200/81 R, 83 R; 25/610, 615

[56] References Cited

U.S. PATENT DOCUMENTS

| | | | |
|---|---|---|---|
| 1,731,119 | 10/1929 | Abbott et al. | 336/241 X |
| 2,039,641 | 5/1936 | Fichtner | 219/523 X |
| 2,102,783 | 12/1937 | Bokovoy | 219/209 X |
| 2,157,884 | 5/1939 | Backer | 29/617 |
| 2,389,587 | 11/1945 | Appleman | 338/242 X |
| 2,424,848 | 7/1947 | Reitan | 338/217 X |
| 3,095,492 | 6/1963 | Gaiennie | 338/217 X |
| 3,195,093 | 7/1965 | Dillon | 338/273 |
| 3,229,358 | 1/1966 | Scadron et al. | 219/534 X |
| 3,513,540 | 5/1970 | Boggs | 29/611 |
| 3,582,616 | 6/1971 | Wrob | 219/541 |
| 3,898,431 | 8/1975 | House et al. | 219/544 |

FOREIGN PATENT DOCUMENTS

| | | | |
|---|---|---|---|
| 650765 | 10/1937 | Fed. Rep. of Germany | 338/238 |
| 519003 | 1/1921 | France | 219/523 |
| 227939 | 10/1943 | Switzerland | 219/331 |

*Primary Examiner*—Bruce A. Reynolds
*Assistant Examiner*—M. M. Lateef
*Attorney, Agent, or Firm*—Antonelli, Terry, Stout & Kraus

[57] ABSTRACT

An elongated heater unit including an elongated resistor helix, terminals connected to the ends of the helix, at least a first surrounding metallic sheath, powder insulation material disposed within the first sheath and spacing the resistor helix from the sheath. The sheath is provided with at least one indentation and/or groove extending along at least a portion of the length of the first sheath. The method for constructing the heater unit includes forming the indentation by means of a roll with a protrusion, by utilizing a mandrel, by utilizing a temperature sensitive member or by utilizing a reducing sheath.

48 Claims, 7 Drawing Sheets

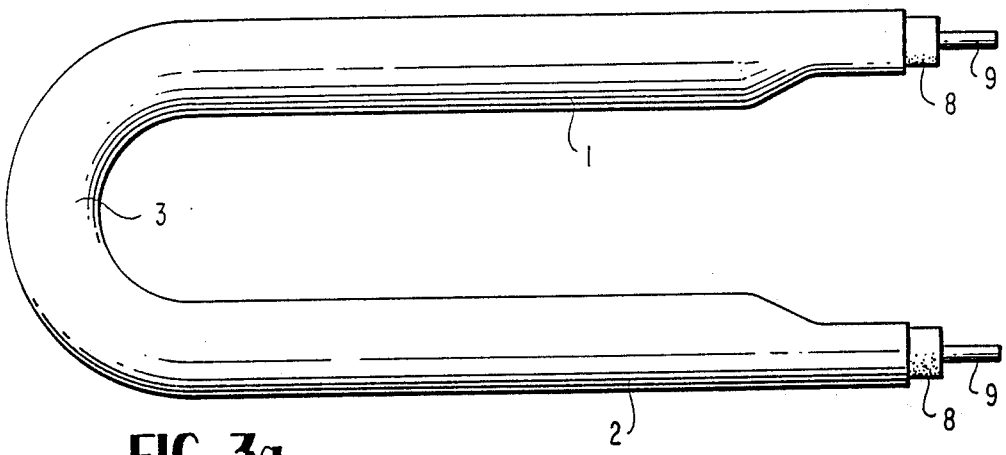
FIG. 3a
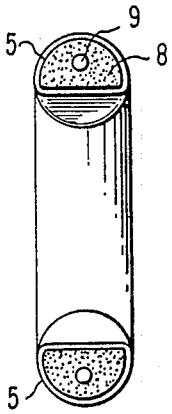
FIG. 3b
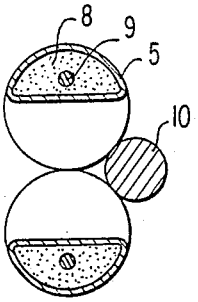
FIG. 4a
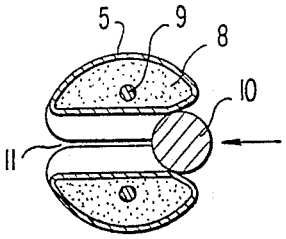
FIG. 4b
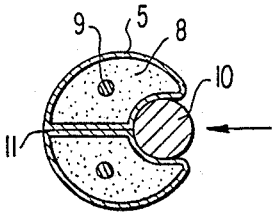
FIG. 4c
FIG. 5
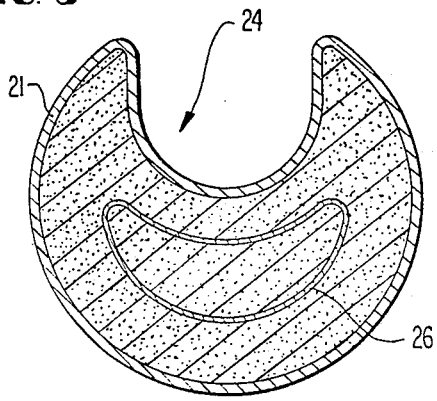
FIG. 6
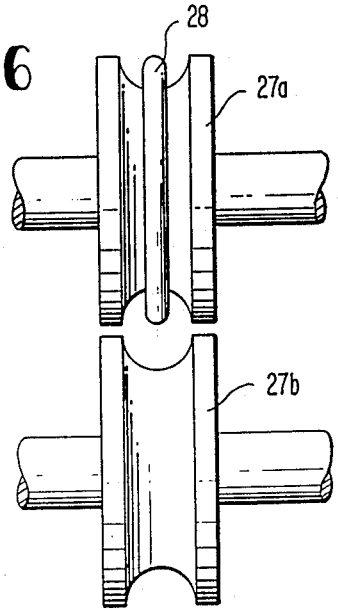

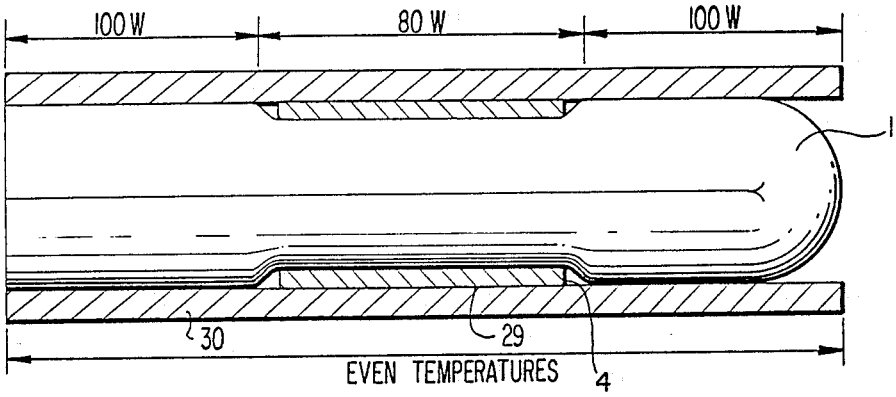
FIG. 10
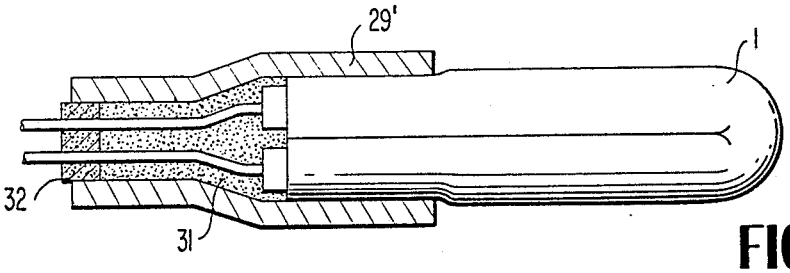
FIG. 11
FIG. 14
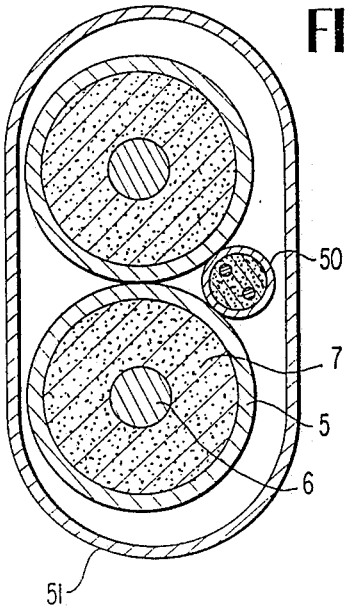
FIG. 15
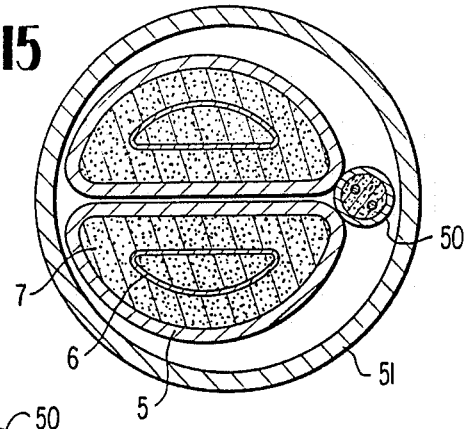
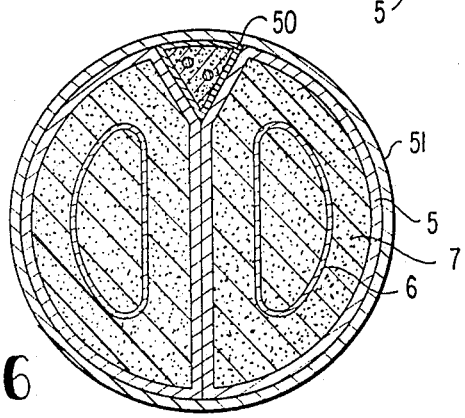
FIG. 16

HEATER UNIT

This is a continuation of application Ser. No. 301,134 filed Sept. 11, 1981 now abandoned, which is a continuation of application Ser. No. 513,140 filed Oct. 8, 1974, now U.S. Pat. No. 4,349,727, which is a continuation-in-part application of application Ser. No. 382,295 filed July 25, 1973, now U.S. Pat. No. 3,982,099 and Reissued as Re. No. 30,126.

The present invention relates to an elongated cartridge type or tubular heater unit having an indentation extending at least along a portion of the length thereof and a method for constructing the same.

Tubular or cartridge type heater units have many uses and are generally elongated members and generally have a somewhat circular cross section so as to permit the utilization thereof in drilled holes or the like. A typical heater unit is the so-called "calrod" heater unit which is an elongated heater having terminals at opposite ends of the unit. In particular, the calrod unit generally consists of an elongated resistor helix extending between terminals which resistor assembly is spaced from a surrounding elongated tubular sheath be means of an insulating powdered material such that the terminals extend out of the heater unit at opposite ends thereof. Tubular heater units may also be of bilateral construction as disclosed in my copending application Ser. No. 382,295 filed July 25, 1973 now U.S. Pat. No. 3,982,099 and reissued as RE. No. 30,126 method and construction disclosed therein, the subject matter of my copending application being incorporated herein by reference.

My copending application discloses a heater unit of bilateral construction which is formed by forming a resistor assembly of a resistor helix extending between terminals and overlapping the same, inserting the assembly in a sheath tube, filling the tube with insulating powder, placing end plugs over the terminals, bending the tube into a U-shape, pressing the legs of the U together and feeding the pressed unit through swaging dies or the like to deform the tube over the length thereof so as to provide a heater unit of an elongated member bent over upon itself. The resultant construction of such a heater unit provides two interconnected substantially parallel leg portions of substantially semicircular cross section with the resultant cross section of the heater unit being substantially circular and the terminals being at the same end of the heater unit. The heater unit as disclosed in RE. No. 30,126 easily withstands a dielectric voltage test of 2500 volts.

It has been found that in the prior art the heater units do not always provide substantially even temperatures over the length thereof, but rather, temperature gradients naturally occur along the length of the heater unit. In some cases, it has been found that such variation in temperature along the length of the heater results from the fact that the ends of the heater mass give up heat more readily than the center portions. While a heater unit having temperature gradients along the length thereof is utilizable in some applications, in other applications it is necessary to maintain a substantially even temperature over the length of the heater unit or a particular portion of the length of the heater unit. Although it is possible to provide a heater unit with extended length so as to provide a predetermined area of substantially even temperature, due to space limitations as well as other factors, such a solution is not always practical.

It is noted that in some applications, it is often necessary to provide for accurate control of the heater temperature such as, for example, in the cutting of polyvinylchloride film wherein the cutting of such film at excess temperature causes potentially harmful gasses or the like to be produced. Further, it is often desired to accurately detect and control the temperature of the heater unit without inserting temperature sensors into the insulation material while maintaining good thermal conductivity with the sensor and heater unit for accurate detection. Although a sensor may be placed against the heater, placing a sensor on a surface of the heater unit changes the resultant overall configuration of the heater unit and sensor which prevents utilization of a heater unit of maximum size in for example a drilled hole due to the addition of the sensor mechanism. Additionally, mere placement of a sensor on a surface of the heater unit does not always provide for good thermal conductivity and/or for accurate detection of the heater temperature, except in the immediately adjacent area.

It is therefore an object of the present invention to overcome the problems of the prior art arrangements.

It is another object of the present invention to provide an elongated heater unit having an indentation extending at least along a portion of the length thereof and a method for constructing the same.

It is another object of the present invention to provide a heater unit in which the indentation forms a groove which is variable in length and/or depth and/or cross-sectional configuration.

It is another object of the present invention to provide an elongated heater unit having an indentation or groove extending about the circumference thereof.

It is another object of the present invention to provide a heater unit with a groove wherein the groove is adapted for receiving a temperature sensing member which serves for sensing the temperature of the heater unit and which may be utilized for accurately controlling the temperature thereof.

It is a further object of the present invention to provide a heater unit having a groove in which the groove receives a temperature sensing member in good thermal conductive contact with the heater unit.

It is yet a further object of the present invention to provide a heater unit with a temperature sensing member disposed within a groove or indentation of a sheath of the heater unit.

It is another object of the present invention to provide a heater unit with a temperature sensing member disposed between an inner and outer sheath of the heater unit and within an indentation or groove of the inner sheath such that a substantially circular cross-sectional configuration of the combined heater unit and sensing member is provided.

In accordance with the present invention, there is provided an elongated heater unit in which a resistor assembly is spaced from a surrounding elongated sheath by powdered or granulated insulating material, and an indentation is provided in the sheath and extends along at least a portion of the length of the sheath.

According to another feature of the present invention, the indentation may serve for providing uniform heating of the heater unit along the length thereof. The indentation may define a groove which is variable in length and/or depth and/or cross-sectional configuration.

In accordance with another feature of the present invention, an elongated mandrel of predetermined cross-sectional configuration is positioned proximate to the area of the longitudinally extending member in which the indentation or groove is to be formed and the mandrel and heating unit are passed through swaging dies so that the heating member is deformed in a manner to receive the mandrel with the mandrel then being removed to define a groove within such heating unit. In the case of a calrod unit, the groove may also be formed by passing the heater unit through a rolling mill, the rolls of which have an outwardly extending portion corresponding to the desired groove to be formed.

In accordance with another feature of the present invention, the grooved heater unit is arranged for receiving a temperature sensitive member within the groove thereof, which temperature sensitive member is in good thermal conductive relation with at least an inner sheath of the heater unit. The temperature sensitive member senses the temperature of the heater unit and controls the temperature thereof via a heater control member.

According to a further feature of the present invention, the temperature sensitive member and the heater unit may be encased in an outer sheath and subsequently deformed by passing the same through swaging dies or the like so as to provide an integral heater unit and sensing member.

In accordance with a further feature of the present invention, the mandrel may be in the form of a solid thermocouple such that a groove is formed in the heater unit by the thermocouple with the thermocouple being retained in the groove and utilized as the sensing member for controlling the temperature of the heater unit. The heater unit and the thermocouple are preferably encased in an outer sheath and passed through swaging dies or the like so as to provide an integral heater unit and thermocouple sensing member.

These and further objects, features and advantages of the present invention will become more apparent from the following description when taken in connection with the accompanying drawings which show, for purposes of illustration only, several embodiments in accordance with the present invention, and wherein:

FIGS. 1*a*–1*c* are respectively side, end and top views of a bilateral heater with an elongated indentation or groove in accordance with the present invention;

FIGS. 2*a*–2*d* illustrate different cross-sectional groove configurations;

FIGS. 3*a*–3*b* illustrate end and top views of the hairpin configuration of the heater;

FIGS. 4*a*–4*c* illustrate end views of different stages of heater formation with an indentation;

FIG. 5 is a cross-sectional view of a heater with a groove;

FIG. 6 illustrates a rolling unit for formation of indentations in heaters;

Figure 8A:
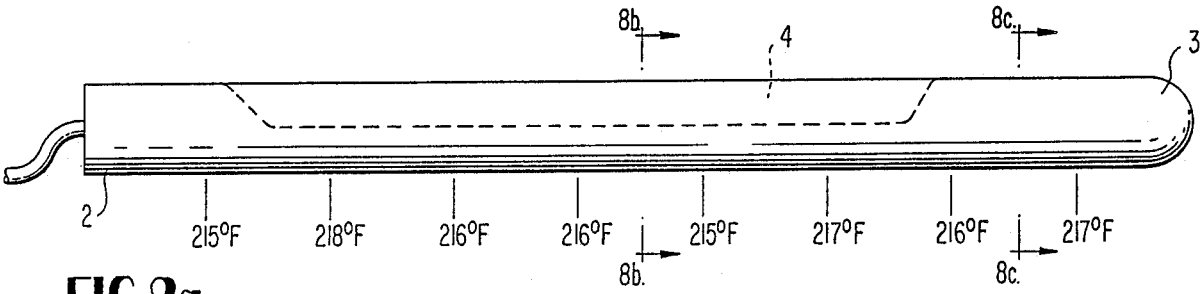
Figure 8B:
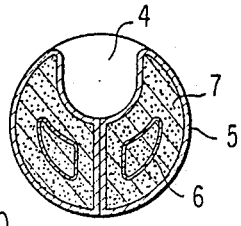
Figure 8C:
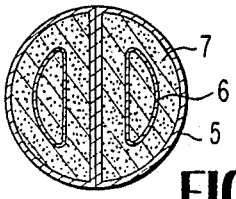
Figure 9A:
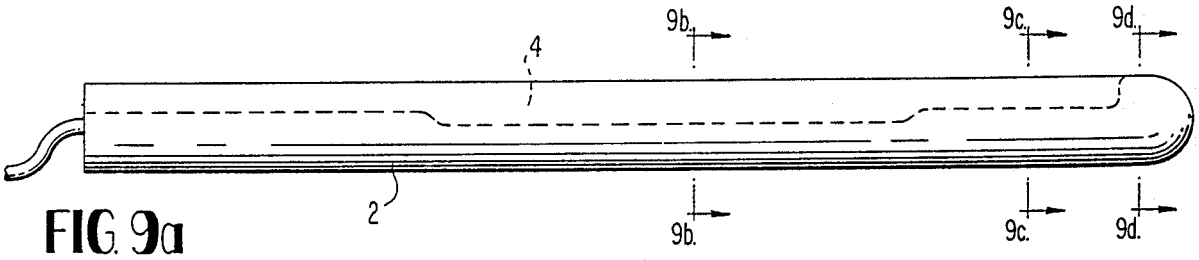
Figure 9B:
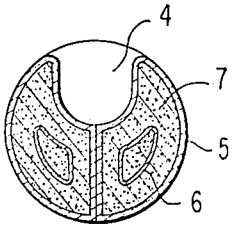
Figure 9C:
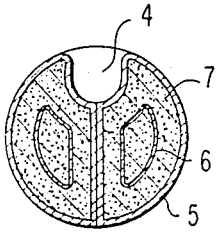
Figure 9D:
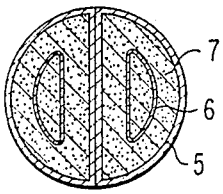
Figure 12B:
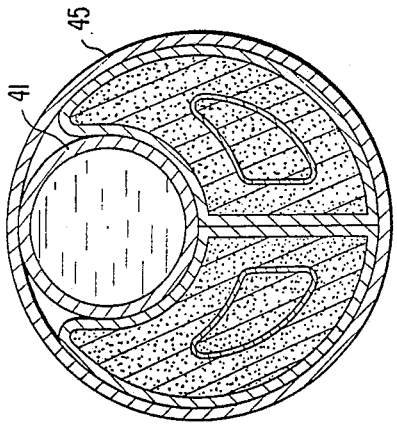
Figure 13B:
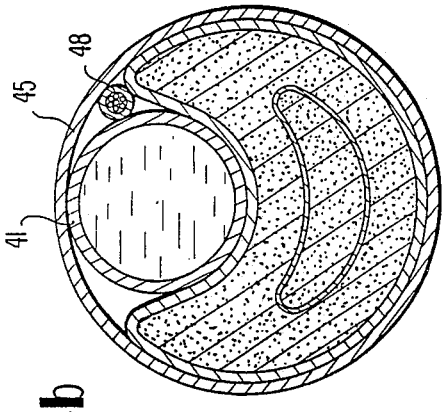
Figure 12A:
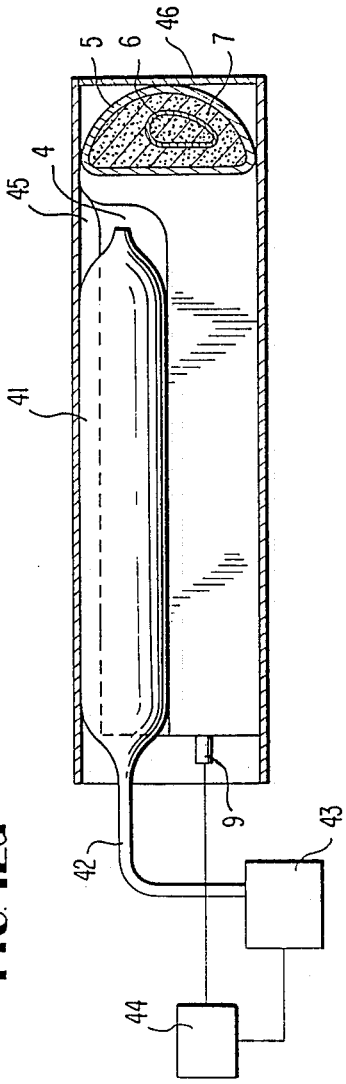
Figure 13A:
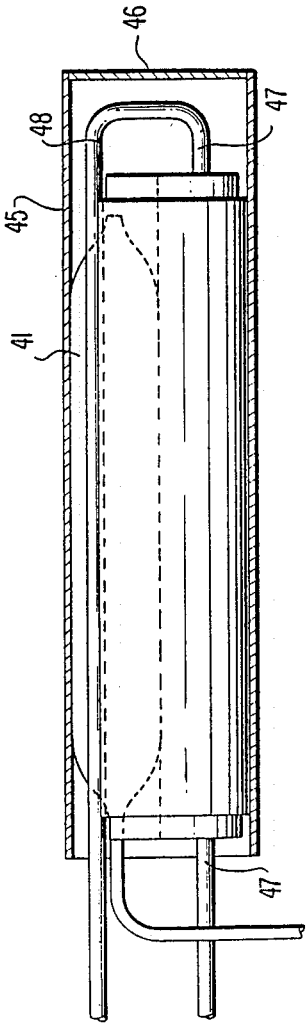
Figure 17:
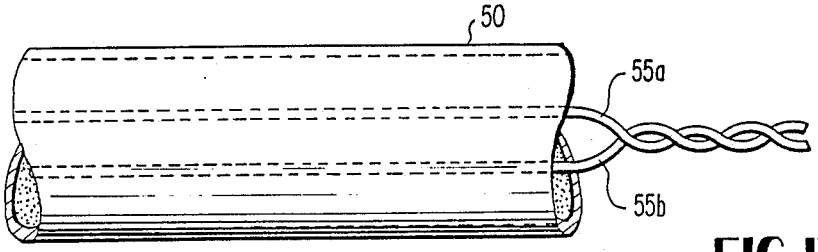
Figure 18:
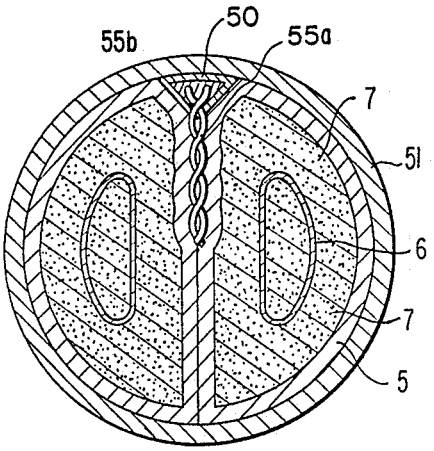
Figure 19:
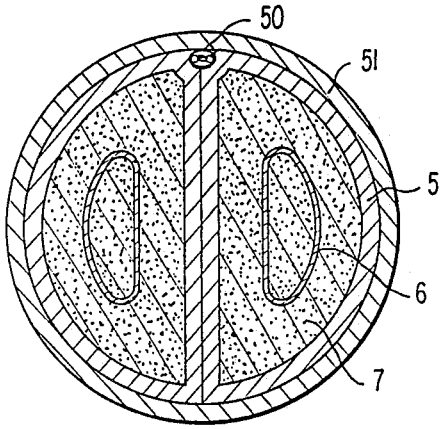
Figure 20:
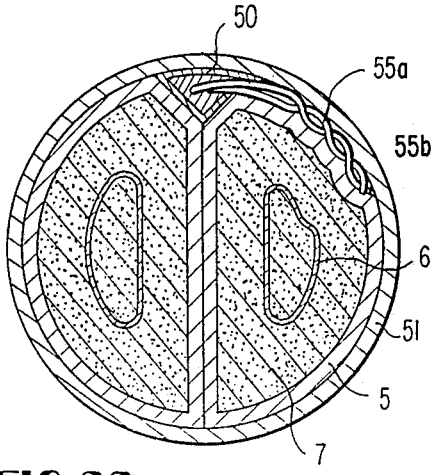
Figure 21:
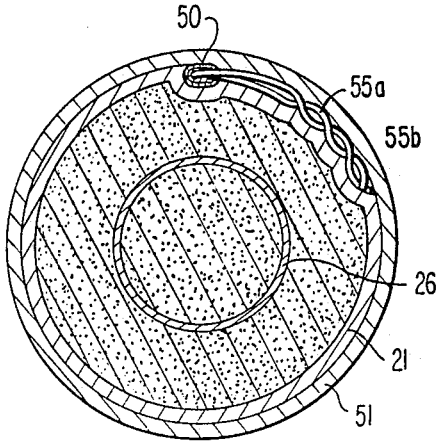
Figure 22:
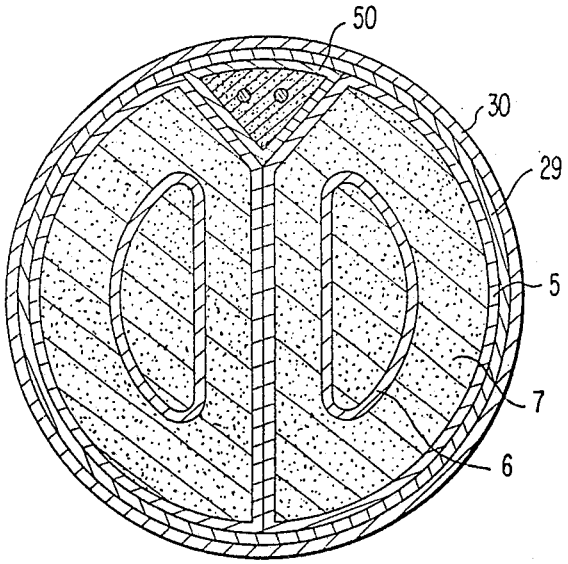

FIGS. 8*a*–8*c* illustrate a heater construction in accordance with the present invention to compensate for temperature gradients with FIG. 8*a* being a side view and FIGS. 8*b* and 8*c* being cross-sectional views;

FIGS. 9*a*–9*d* illustrate another heater configuration in accordance with the present invention;

FIG. 10 illustrates a heater with a reduction sheath and outer sheath in accordance with the present invention;

FIG. 11 illustrates a heater unit with an extended cold zone formed by a portion of the reduction sheath;

FIGS. 12*a* and 12*b* are respectively a side view and cross-sectional view of a grooved bilateral heater with temperature sensor in accordance with the present invention;

FIGS. 13*a*–13*b* are respectively a side view and cross-sectional view of a calrod heater with temperature sensor in accordance with the present invention;

FIG. 14 illustrates an assembly of a thermocouple, heater and outer sheath prior to swaging in accordance with the present invention;

FIG. 15 illustrates another assembly of a thermocouple, heater and outer sheath piror to swaging;

FIG. 16 is a cross-sectional view of a completed bilateral heater with thermocouple sensor;

FIG. 17 illustrates a thermocouple and junction utilized with heaters in accordance with the present invention;

FIG. 18 is a cross-sectional view of a bilateral heater with thermocouple sensor wherein the thermocouple junction is disposed in the heater seam;

FIG. 19 is a cross-sectional view of another arrangement of the thermocouple junction in the bilateral heater;

FIG. 20 is a cross-sectional view of still another arrangement of the thermocouple junction in the bilateral heater;

FIG. 21 is a cross-sectional view of a calrod heater with a thermocouple;

FIG. 22 is a cross-sectional view of another arrangement of a thermocouple junction under a reducing sheath; and FIGS. 23*a*–23*d* illustrate a heater construction utilizing a thermistor sensor.

Figure 1B:
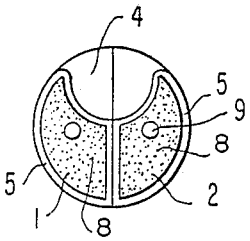
Figure 1A:
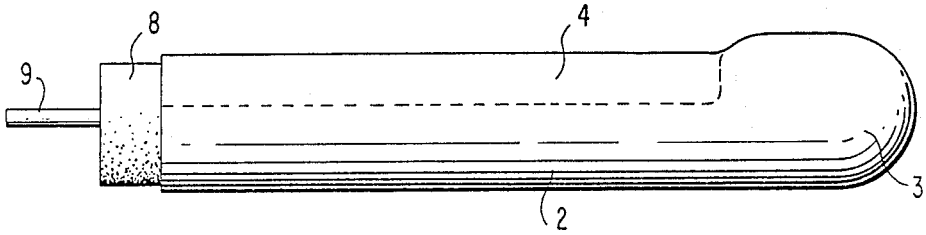
Figure 1C:
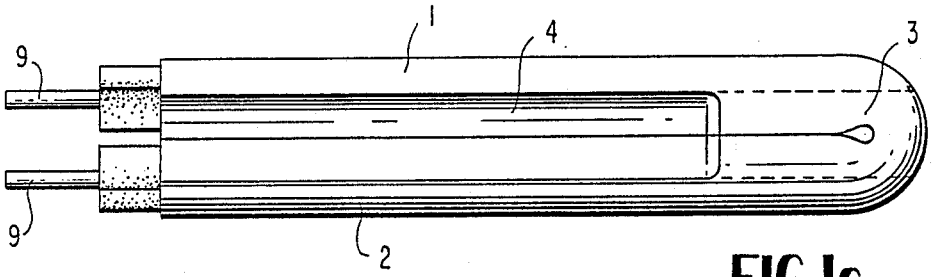
Figure 2A:
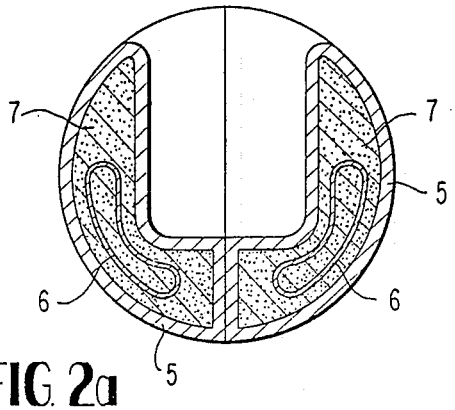
Figure 2B:
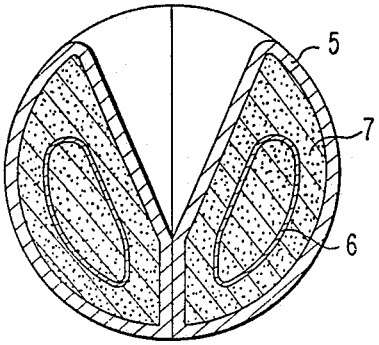
Figure 2C:
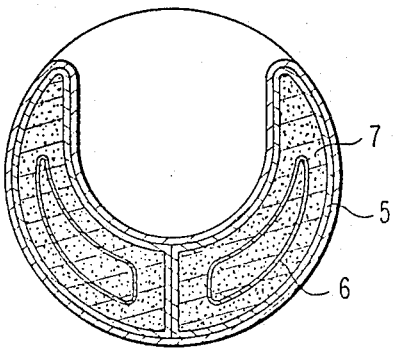
Figure 2D:
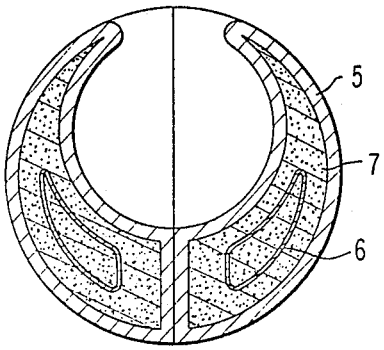

Referring now to the drawings wherein like reference numerals are utilized to designate like parts throughout the several views, there is shown in FIGS. 1*a*, 1*b* and 1*c*, a side view, end view and top view of a bilateral heater unit of the type disclosed in my copending application having a groove extending along at least a portion of the length thereof. As shown in FIGS. 1*a*, 1*b* and 1*c*, the heater unit has two legs, 1 and 2 joined by an interconnecting portion 3 with an indentation preferably extending along at least a portion of each of the leg members in the region of the seam of the heater unit so as to define a groove 4. Although as shown in FIG. 1*a*, the groove does not extend into the region of the interconnecting portion 3, the groove may extend along the entire length of the sheath 5 of the heater unit as shown in dashed line, for example, in FIG. 1*c*. As shown in FIG. 1*b* the groove has a somewhat U-shape and the groove may be provided with several differently configured cross sections. For example, the groove may have substantially flat sides and bottom as shown in FIG. 2*a*, a triangular cross section as shown in FIG. 2*b*, straight sides and a radius bottom as shown in FIG. 2*c* or a substantially circular cross section as shown in FIG. 2*d*. It is noted that the shape of the groove is determined by the shape of the tool utilized for forming such groove. Additionally, it is noted that the resistor helix 6 of the heater unit generally conforms to a shape corresponding to the cross-sectional shape of the sheath of the respective leg of the bilateral heater unit as shown in FIGS. 2*a*–2*d*. Similarly, the end caps or insulators may also be deformed to a similar shape.

The bilateral heater unit is formed in accordance with the method disclosed in RE. No. 30,126 by providing a metal sheath enclosing a helical resistance element which is spaced and insulated from the sheath by powdered insulating material 7 such as magnesium oxide packed by vibration. Insulating end caps 8 are provided at the ends of the sleeve which caps may be of natural mica, of mica paper, of silicon rubber, woven fiberglass, silicon impregnated woven fiberglass or of any compressible material provided that such material has appropriate electrical insulating properties and tolerance for the required service temperatures. The sheath in the area of the end caps and the end caps are deformed, for example, by crimping, to such an extent that the area which they occupy is substantially reduced. To prevent shattering, fracturing or breaking of such end caps, these end caps are preferably easily compressed and fit loosely around the terminal extending from the sheath and to which the resistor helix is connected. The crimping of the heater ends to close the sheath ends and to force the end caps closely around the terminal 9 is done to prevent the loss of insulation from around the loose end caps. The crimped cross section is normally about one-half of the heater diameter but may vary in accordance with the terminal diameter and end plug material.

The heater is formed into a hairpin or U-shape in the manner disclosed in RE. No. 30,126, preferably with the flats of the crimped ends opposed as shown in FIGS. 3*a* and 3*b*. The heater legs are squeezed together as disclosed in my copending application and as shown in FIG. 4*a*, a mandrel or rod 10 of the appropriate shape and length is fed into the swaging dies along the side of the heater. During passage through the dies, the mandrel is progressively pressed into the heater seam 11 as shown in FIGS. 4*b* and 4*c* which generally represent passage halfway through the dies and completely through the dies, respectively. During passage through the dies, the mandrel is progressively pressed into the heater seam, while the part of the heater in direct contact with the dies takes the shape of the dies, while that part in direct contact with the mandrel conforms to its shape. After swaging, the mandrel is removed, such that the otherwise approximately cylindrical heater is provided with a groove extending along at least a portion of the length thereof, and such heater as illustrated in FIG. 1*c* is capable of withstanding testing voltages greater than 2200 volts.

Although the above description of the present invention has been directed to a bilateral heater, the present invention is not limited thereto, but for example a groove may be also provided in a calrod heater unit as shown in FIG. 5. This figure is a cross-sectional view of a calrod heater having a sheath 21 of originally cylindrical cross section which has been deformed to provide a groove 24 extending along a portion of the length thereof. Additionally, as shown in this figure, the resistor helix 26 also is deformed to a shape generally conforming to the shape of the outer sheath. As with the bilateral heater unit, the groove of the calrod heater may be of varying length and/or depth and/or cross-sectional configuration. The groove may be formed in the calrod unit for example, by passing the heater unit through opposed rolls 27*a* and 27*b* as shown in FIG. 6 and in which at least one of the rolls is provided with a protrusion 28 for forming the groove. The groove may also be formed, utilizing a mandrel by the method disclosed for swaging a groove into a bilateral heater.

Figure 7:
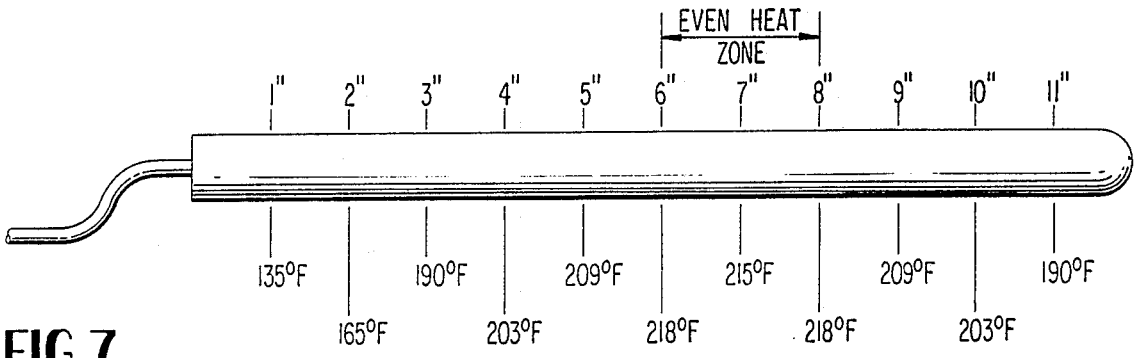
FIG. 7 is a hypothetical temperature map depicting temperature gradients in a conventional heater.

The provision of an indentation or groove in the heater unit may serve for providing an even heat zone in at least a predetermined area along the length of the heater and/or may serve for receiving a temperature sensitive member therein. As to the utilization of an indentation or groove for providing an even heat zone, it has been found that when the heater is deformed to compact the granular or powdered insulation, the wire of the resistor helix experience compression forces which thickens the wire cross section to different degrees at different areas of the heater, depending on the amount and nature of the deformation. It is relatively constant for one amount and type of deformation. This results in a decrease in the resistance of the helix which decrease is proportional to the amount of volume reduction accomplished by the particular type of deformation. Thus, for example, as shown in FIG. 7, which is a hypothetical temperature map depicting temperature gradients due to end losses along the extent of a heater unit (the end cap 8 not being shown), there is shown an even heat zone in only a minor portion of the length of the heater unit in which the temperature varies between 215° F. and 218° F. However, by providing an indentation or groove along at least a portion of the heater unit of bilateral construction (the end cap 8 not being shown), a substantially even heat zone can be provided along a predetermined length thereof as for example, shown in FIG. 8*a*. In this manner, the end losses for the heater unit are compensated by providing a high resistance and higher power output at the end portions and a lower resistance and lower power output portion in the middle region of the heater such that a substantially even heat zone is provided. FIGS. 8*b* and 8*c* represent cross sections of the heater unit of FIG. 8*a* along section lines 8*b*—8*b* and 8*c*—8*c*. As shown in FIGS. 9*a*–9*d*, the indentation or groove may be formed in the heater unit with varying length and/or depth and/or cross section. It is noted that the section at 9*d*—9*d* illustrated in FIG. 9*d* corresponds to that of FIG. 8*c* (the end cap 8 not being shown). Thus, if the heater is deformed to a lesser degree at any given spot or portion of its length, the resistance is reduced less as a result and the area in which the resistance has been reduced less has a higher resistance than the other areas of the heater unit with the result that this high resistance area generates more heat. If the areas of lesser deformation are located at the ends of the heater, they will generate more heat and compensate for additional losses there and give the heater a substantially more even temperature across its length. The type of mandrel utilized as the grooving tool will of course determine the cross-sectional shape of the groove provided and the manner in which the grooving tool is utilized can provide a variation in depth and/or length of the groove.

As shown in FIG. 10, the bilateral heater 1 can be provided with an indentation or groove 4 which not only extends along a portion of the length of the heater, but also extends about the circumference of the heater sheath such that an annular indentation or groove is formed which serves for reducing the diameter of the heater at selected areas thereof. Such selective reduction may be accomplished using a rotary swaging machine or rolling mill. A "reducing sheath" 29 which is a tube of appropriate wall thickness and length is placed over the heater at the area to be reduced and then with the heater is passed through swaging dies, rolls or the like which reduces the tube onto the heater and forming an indentation or groove in the heater sheath. In the selected area, the heater is reduced in diameter more than in the other areas and to an extend equal to approximately twice the thickness of the reducing tube wall although a lesser reduction may be provided. If a uniformly cylindrical surface is desired, an outer sheath 30 is reduced over the assembly of the bilateral heater and reducing sheath as shown.

The advantages of utilizing a reducing sheath to provide an annular indentation or groove is that a conventional swaging machine or rolling mill can be utilized and the reducing sheath's wall thickness and length are easily controllable with any excess material providing for increased length of the indentation or groove. Further, by selective annular reduction, the bilateral heater can be zoned with areas of greater or lesser wattage outputs as shown in FIG. 10. It is very useful in reducing the power output in the center area (80 watts) relative to the ends (100 watts) and allows the ends to produce higher wattages to compensate for end losses with the overall results being approximately even temperature along the heater length.

The reducing sheath can be utilized to extend the cold end of the heater as for example illustrated in FIG. 11 wherein the reduction sheath extends over only a portion of the heater and outwardly therefrom. The hollow end of the reduction sheath may be left empty or may be filled with high temperature cement, sealing compounds of rubber or resin, preformed ceramic insulators, or any suitable material having appropriate electrical insulation and heat resistance properties. As shown in FIG. 11, the reduction sheath 29′ is filled with granular or powdered MgO 31 and capped with an insulating end cap 32 to contain the insulation powder. The reduction sheath, if desired, can be further reduced along its entire length or only a portion thereof to compact the insulation to form a compacted powder insulation as shown.

As shown in FIGS. 12*a* and 12*b*, the elongated groove is adapted to receive a temperature sensor in the form of an elongated cylindrical member 41 mounted within the heater groove 4 and which serves for sensing the temperature of the heater unit. The temperature sensor may be a standard liquid-filled sensing bulb with capillary extension, such bulb being typically 3/16″ to ⅜″ in diameter, depending on heater unit diameter, and of varying length, for example, Robertshaw Controls Co. type B-10 thermostat. The length of the bulb is generally chosen to correspond to the length of the groove and the bulb is filled with a liquid which expands or contracts with temperature changes. The expansion and contraction of the liquid is transmitted via an interconnecting capillary tube 42 to a unit 43 which may comprise a diaphragm, or a piston in cylinder, which are responsive to the movement of the fluid. An output from the diaphragm unit 43 is provided to a unit 44 which controls the application of electrical power to the terminals of the heater unit as for example by opening and closing a switch in a line supplying power to the heater unit terminals. In this manner, the heater is cycled on and off according to the heater temperature and the temperature setting of the thermostat. The groove of the heater unit is normally radiused with approximately the same radius as that of the sensing bulb so as to provide for close intimate contact of the bulb and the heater unit which ensures rapid heat transfer giving accurate sensing of the heat temperature. A closer than approximate match of groove and bulb cross sections is not required because swaging makes it conform to the groove. The sensing bulb is normally mounted by laying it in the heater groove and sliding this assembly into a loose fitting surrounding sheath 45, then swaging this outer sheath 45 slightly to squeeze it against both the sensing bulb and the grooved heater. The bulb may be compressed somewhat by the reduction of the outer sheath which also makes it conform to the contour of the groove and results in an approximately circular cross-sectional configuration of the combined heater unit and temperature sensor. The open end of the outer sheath may be closed for example by solder 46 forming an end seal or may be slightly tapered or reduced onto the sheath to form a different type of seal.

As shown in FIGS. 13*a* and 13*b*, the sensing unit in the form of the sensing bulb 41 may also be utilized with a calrod unit having a groove formed therein. As shown, since the calrod unit has terminals 47 at opposite ends thereof, a return conductor 48 from one end terminal may be provided which extends within the groove of the calrod heater. Here again, an outer sheath 45 is preferably placed over the entire assembly and swaged so as to ensure intimate contact of the sensing bulb and the heater unit. Additionally, an end seal 46 may be provided with such arrangement, for gas or water tight seal, if required.

The present invention also provides for making a metal sheath thermocouple sensor integral with the heater unit. As shown in FIGS. 14 and 15, after the bilateral heater unit is formed to the point in which the legs are pressed together, a cylindrical, preferably magnesium oxide insulated metal sheath therocouple 50 is laid in the seam between the legs and this whole assembly is slid into another larger sheath. The whole assembly is then swaged to a substantially circular cross section as shown in FIG. 15 in which a groove of substantially triangular cross section is formed by the thermocouple member and the thermocuple serves as the sensing member. Alternatively, the heater may be swaged somewhat after squeezing the legs together whereby the heater is swaged to a rougly cylindrical cross section by swaging at less than the full extent of reduction it would normally undergo as for example, shown in FIG. 15, whereby the smaller circumscribing diameter of the thermocouple and heater unit permits the insertion thereof into a smaller cylindrical outer sheath 51 which is more readily available and processable. The sheath is then swaged to provide a resultant configuration as shown in FIG. 16. The thermocouple normally exits from the terminal end of the heater for easy connection to a suitable controlling instrument, although it may exit from the bend end. Because of the firm and extensive contact with the heater unit, the thermocouple accurately senses the adjacent sheath temperature. It is noted that although the thermocouple is preferably positioned at the heater seam, the thermocouple may be positioned along any portion of each leg of the heater unit or along the sheath of a calrod unit and will be deformed to define a groove as well as being in intimate contact with the heater unit. For example,the thermocouple may be positioned between the heater legs or at any position between a heater leg and the outer sheath with the resultant unit having a substantially circular cross section.

The thermocouple material utilized to form the integral thermocouple sensor and heater unit is metal sheathed and magnesium oxide insulated as shown in FIG. 17. The material is cut to the desired length and at one end, the metal sheath is stripped back so as to expose the two wires 55*a* and 55*b*. The wires are twisted together to form a connection and the thermocouple sensor is then placed between the heater sheath and the outer sheath in the manner indicated above. However, in order to ensure a firm mechanical and electrical connection, the twisted wires may be placed between the flat portions of the heater legs before sliding the outer sheath over such assembly prior to the swaging or rolling operation as shown in FIG. 18. Alternatively, the twisted wires can be placed in the seam of the bilateral heater sheath or can be wrapped around the heater sheath as shown in FIGS. 19 and 20, respectively. This arrangement provides a sensing point just under the outer sheath and in close proximity to the heater's exposed surface for close accurate regulation of surface temperatures. The subsequent step of swaging the assembly forms a good low resistance connection by virtue of the high pressure generated and the wires are pressed together with a force such that the possibility of oxidation at the wire interconnection or junction is reduced. Such oxidation might otherwise result in an insulation of the wires from one another. The high pressure conncetion reduces the need for soldering, brazing or welding the two wires before installation in the heater unit although such a connection may be provided. Additionally, the swaging operation molds the heater and thermocouple junction to each other with the thermocouple becoming an integral part of the finished heater unit whereby excellent heat transfer to the thermocouple is provided which results in effective regulation of the heater temperatures.

As shown in FIG. 21, a calrod unit may also by provided with a thermocouple sensor 50 by placing the thermocouple along the calrod unit and placing the twisted exposed wires 55 of the thermocouple on the sheath 21 of the calrod. This assembly is then placed in an outer sheath 51 which is swaged over the assembly mating the thermocouple to the calrod and forming an indentation or groove in the sheath of the calrod in which the thermocouple is disposed.

FIG. 22 is a cross-sectional view of a bilateral heater unit of the type illustrated in FIG. 10 having a reducing sheath 29 and an outer sheath 30 and provided with a thermocouple 50 with the thermocouple junction being located in the seam under the reducing sheath 29. This arrangement provides for a heater unit with even surface temperatures and with heat control via the thermocouple sensor.

Figure 23A:
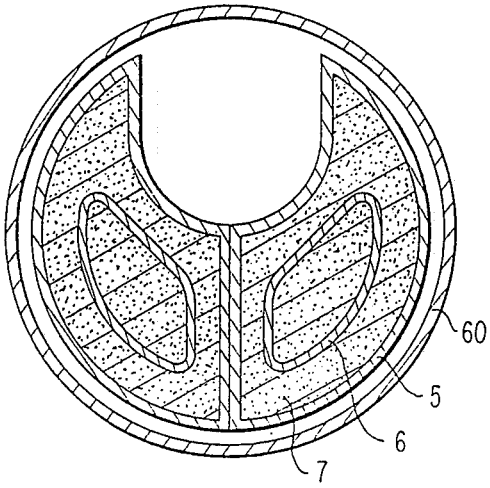
Figure 23B:
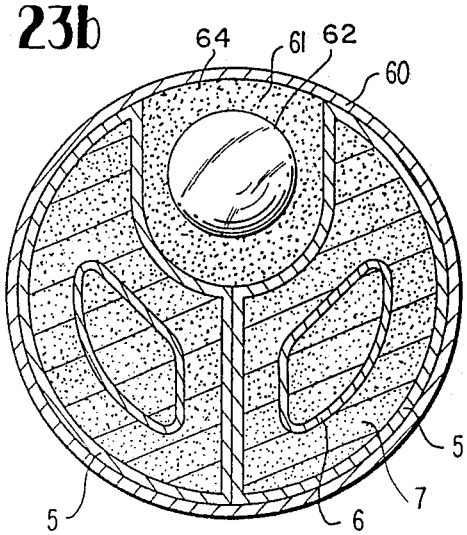
Figure 23C:
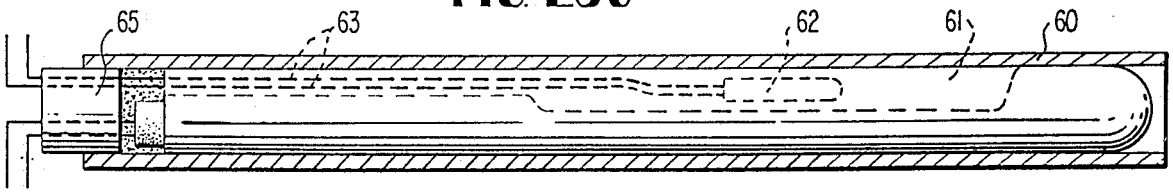

In accordance with the present invention, a thermistor sensor may be located in the grooved heater whether it be of bilateral construction or calrod type. The groove in such heater is formed in the manner disclosed above. The formed grooved heater is placed within an outer sheath 60 of sufficient inside diameter as shown in FIG. 23*a* with the outer sheath then being reduced in diameter, as for example, by swaging or rolling such that the outer sheath tightly engages the heater sheath as shown in FIG. 23*b* while maintaining a substantially circular cross section. Generally, the heater is only slightly compressed during this operation and a well 61 is formed which is delimited by the heater legs 5 and the outer sheath 60. A thermistor sensor 62 of appropriate size is suspended by the lead wires 63 thereof within the well as shown in FIGS. 23*b* and 23*c*. The well is preferably then filled under vibration with powder insulating material 64 such as magnesium oxide with the open end of the heater being capped with suitable electrically insulating, temperature tolerant compressible material 65. Alternatively, the open end of the well rather than the open end of the heater may be capped with a suitable material. The entire unit is then reduced in diameter, for example, by five or ten percent.

Figure 23D:
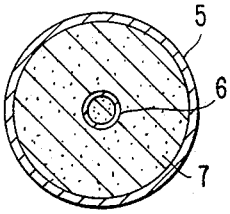

FIG. 23*d* is a cross-sectional view of the heater at the middle area of the return bend portion illustrating the resistor helix 6 thereat having a substantially circular cross-section corresponding to the substantially circular cross-section of the sheath 5 thereat.

The reduction in diameter serves for compacting the insulating material such that it is pressed about the thermistor element. The compacted MgO provides an effective thermal path from both the outer sheath and the adjacent heater legs. Consequently, the sensor readily detects small temperature variations in the outer sheath as well as changes in heater output so as to provide accurate signals to a temperature controller as, for example, shown in FIG. 12*a*. The heater thus maintains a desired set-point temperature with only minimal variations due to heater cycling or to the thermal shock of process work loading. As shown in FIG. 23*c*, the groove of the heater may have a varying configuration so as to provide for substantially even surface temperatures as discussed above.

The utilization of a relatively crushable material, such as granulated MgO as a filler for the well in which the thermistor is suspended provides for a cushioning effect during the subsequent reduction procedure and additionally has excellent electrrical insulating properties such that in the event of breakage of the thermistor glass bead insulator, the thermistor element itself will not be short-circuited enabling continued use of the heater. Further, the lead wires of the thermistor are also insulated by the surrounding MgO. It is noted, however, that the thermistor could also be encased by suitable thermally conductive materials other than MgO as, for example, conventional electrical cements. Such materials could be poured into the well and permitted to harden without further compaction or reduction in diameter of the heater unit. However, such materials are susceptible to the formation of voids which would inhibit effective thermal transfer. Additionally, some materials may lack the good electrical insulating properties of MgO.

Obviously, many modifications and variations of the present invention are possible in the light of the above teachings. It should therefore be understood that within the scope of the appended claims, the invention may be practiced otherwise than as specifically described.

I claim:

1. A heater unit comprising resistor means, terminal means connected to the ends of said resistor means, first surrounding elongated metallic sheath means, compacted powder insulation material disposed within said first sheath means and spacing said resistor means from said first sheath means, said first sheath means being provided with indentation means extending along at least a portion of the length of said first sheath means, said first surrounding elongated metallic sheath means including at least one sheath in the form of two substantially parallel adjacent leg portions interconnected by a return bend portion formed of said one sheath bent back upon itself and being integral with the adjacent parallel extending leg portions, said terminal means being provided at the adjacent ends of said one sheath and having said resistor means connected therebetween, said compacted resistor means extending in the direction of said one sheath and being spaced therefrom by said compacted powder insulation material, each of said leg portions of said one sheath having in cross section, at least a first flat surface portion and arcuate surface portions forming a closed loop, said at least first flat surface portions of each leg portion being adjacent and facing one another, said indentation means extending along at least a portion of at least one of said leg portions, whereby said heater unit is capable of withstanding testing voltages greater than 2200 volts.

2. A heater unit according to claim 1, wherein said indentation means is formed as a single groove extending in the longitudinal direction of said first sheath means.

3. A heater unit according to claim 2, wherein said groove has a depth of approximately one half the diameter of the heater unit.

4. A heater unit according to claim 2, wherein said groove is provided with a depth and configuration for receiving a temperature sensing means therein and in good thermal contact therewith.

5. A heater unit according to claim 4, wherein said groove is provided with contours corresponding to the contours of the temperature sensing means.

6. A heater unit according to claim 5, wherein said temperature sensing means is a liquid-filled sensing bulb and said groove is provided with a radiused bottom portion for matching the contours of the liquid-filled sensing bulb.

7. A heater unit according to claim 4, wherein said groove is in mating contact with said temperature sensing means along a major portion of the surface area of said temperature sensing means.

8. A heater unit according to claim 2, wherein said resistor means is a resistor helix having a cross-section configuration corresponding to the cross-sectional configuration of said first sheath means, cross-sectional configuration being non-semicircular.

9. A heater unit according to claim 1, wherein said resistor means is a resistor helix having a cross-sectional configuration generally corresponding to the cross-sectional configuration of said one sheath.

10. A heater unit according to claim 9, wherein said indentation means is formed as a groove bounded at least in part by generally facing surface portions of said first sheath means.

11. A heater unit according to claim 10, wherein said groove is symmetrically disposed with respect to the first flat surface portions of each of said leg portions.

12. A heater unit according to claim 10, further comprising temperature sensing means disposed in said groove for sensing the temperature of the heater unit.

13. A heater unit according to claim 11, wherein said groove extends the entire length of said leg portions and through the return bend portion.

14. A heater unit according to claim 1, wherein said sheath means includes another sheath surrounding both said leg portions and extending along at least a portion of the length of said leg portions.

15. A heater unit according to claim 14, wherein said another sheath extends the entire length of said leg portions and said return bend portion, and said indentation means extends in said one and said another sheath.

16. A heater unit according to claim 14, wherein said another sheath extends in the region of said identation means in said one sheath.

17. A heater unit according to claim 16, wherein said another sheath extends outwardly beyond the ends of said leg portions having said terminal means thereat.

18. A heater unit according to claim 17, wherein said outward extension of said another sheath delimits a chamber having an open end, said chamber being filled with insulation material, insulating cap means being provided for closing the open end of said chamber, and said terminal means extending outwardly through said cap means.

19. A heater unit according to claim 16, further comprising a temperature sensing means disposed in the region of said indentation means in said one sheath.

20. A heater unit according to claim 19, wherein said temperature sensing means includes a thermocouple member having a thermocouple junction disposed beneath said another sheath.

21. A heater unit according to claim 20, further comprising second sheath means surrounding said another sheath and extending at least along the leg portions.

22. A heater unit according to claim 1, wherein said one sheath is completely filled with said compacted powder insulation, said terminal means including end cap means.

23. A heater unit according to claim 22, wherein said resistor means is a resistor helix.

24. A heater unit according to claim 4, wherein said groove is in mating contact with said temperature sensing means along the lowermost portion of said groove.

25. A heater unit according to claim 22, wherein said indentation means is a deformed portion of said one sheath.

26. A heater unit according to claim 1, wherein said resistor means has a cross-sectional shape corresponding generally to the shape of the leg portions in the area of said leg portions and a substantially circular cross-section in the middle area of the return bend portion.

27. A heater unit according to claim 1, wherein said terminal means includes a terminal portion of an electrically conductive material connected with said resistor means and end cap means for spacing said terminal portion from said first sheath means, said resistor means being a resistor helix having a cross-sectional configuration generally corresponding to the cross-sectional configuration of said one sheath, said one sheath being a metallic member, said heater unit being capable of withstanding testing voltages greater than 2200 volts.

28. A heater unit according to claim 27, wherein said end cap means is formed of an electrical insulating compressible material.

29. A heater unit according to claim 1, wherein said terminal means includes a terminal portion of electrically conductive material connected with said resistor means and end cap means for spacing said terminal portion from said first sheath means.

30. A heater unit according to claim 29, wherein said resistor means is a resistor helix having a cross-sectional configuration generally corresponding to the cross-sectional configuration of said one sheath.

31. A heater unit according to claim 30, wherein said end cap means is formed of an electrically insulating compressible material, said one sheath being formed of a metallic material.

32. A heater unit comprising a resistor helix, terminal means connected to the ends of said resistor helix, first surrounding elongated metallic sheath means, compacted powder insulation material disposed within said first sheath means and spacing said resistor helix from said first sheath means, said first sheath means being provided with indentation means extending along at least a portion of the length of said first sheath means, said first surrounding elongated metallic sheath means including at least one sheath in the form of two substantially parallel adjacent leg portions interconnected by a return bend portion formed of said one sheath bent back upon itself and being integral with the adjacent parallel extending leg portions, said terminal means being provided at the adjacent ends of said one sheath and having said resistor helix connected therebetween, said resistor helix extending in the direction of said one sheath and being spaced therefrom by said compacted powder insulation material, each of said leg portions of said one sheath having a non-circular cross section including at least a first flat surface portion and arcuate surface portions forming a closed loop, said at least first flat surface portions of each leg portion being adjacent and facing one another, said indentation means extending along at least a portion of at least one of said leg portions, said resistor helix in the region of said leg portions having a non-circular cross section corresponding to the non-circular cross section of the surrounding sheath of said leg portions.

33. A heater unit according to claim 32, wherein said resistor helix has a substantially circular cross-section in the middle area of said return bend portion.

34. A heater unit according to claim 32, wherein said terminal means includes a terminal portion of electrically conductive material connected with said resistor helix end cap means for spacing said terminal portion from said one sheath, said resistor helix having a cross-sectional configuration generally corresponding to the cross-sectional configuration of said one sheath, said heater unit being capable of withstanding testing voltages greater than 2200 volts.

35. A heater unit according to claim 34, wherein said end cap means is formed of an electrically insulating compressible material.

36. A heater unit according to claim 32, wherein said resistor helix in the region of said return bend portion has a cross section corresponding to the cross section of the surrounding sheath of said return bend portion, said heater unit being capable of withstanding testing voltages greater than 2200 volts.

37. A heater unit according to claim 36, wherein said resistor helix has a substantially circular cross section in the middle area of said return bend portion.

38. A method of forming a heater unit, comprising the steps of providing a heater having an elongated metallic sheath surrounding a resistor helix with powdered insulation material spacing the resistor helix from the sheath and terminal means connected to the ends of the resistor helix extending outwardly from the respective ends of the sheath, the elongated metallic sheath being in the form of two substantially parallel leg portions interconnected by a return bend portion formed of the sheath bent back upon itself and integral with the adjacent parallel extending leg portions, and forming an indentation extending along at least a portion of the length of the sheath.

39. A method according to claim 38, wherein the step of providing a heater comprises the steps of forming a resistor assembly by placing each end of the resistor member over respective end portions of the terminal means such that the resistor member is detachably secured to the respective terminal means and extends therebetween, arranging the resistor assembly in the metallic sheath having a tubular configuration such that the assembly extends in the longitudinal direction of the sheath, filling the sheath with the powdered insulation material, capping the ends of the tubular sheath with end plugs, bending the tubular sheath having the resistor assembly and powder insulation material therein into the shape of a U, pressing the legs of the U together and placing a member for forming an indentation adjacent at least one leg of the sheath, and then deforming the tubular sheath over the entire length thereof to compact the powdered insulation material while forming an indentation in the sheath so as to configure the sheath in the form of two substantially parallel leg portions interconnected by a return bend portion formed of the sheath bent back upon itself and being integral with the adjacent parallel leg portions, each of the leg portions of the sheath having in cross-section at least a first flat surface portion and arcuate surface portions forming a closed loop with at least the first flat surface portion of each leg portions being adjacent and facing one another, and with the indentation extending along at least a portion of the length of the sheath.

40. A method according to claim 38, wherein the leg portions have adjacent and opposing flat surface areas and the step of forming includes placing an outer sheath about a portion of the length of both leg portions and reducing the cross section of the outer sheath so as to form an annular groove in the sheath of the heater.

41. A method according to claim 40, including the step of placing the outer sheath proximate to the ends of said leg portions and extending outwardly beyond the ends of said leg portions such that upon reduction of the cross section of the outer sheath, there is provided an open chamber adjacent the ends of the leg portions.

42. A method according to claim 41, including the step of filling the chamber with insulation material, closing the open end of the chamber with an insulating member and extending terminal means of the leg portions outwardly through the insulating member.

43. A method according to claim 38, wherein the step of forming includes placing a groove forming member adjacent at least one of the leg portions, passing the assembly through a deforming means which presses the groove forming member into at least one of the leg portions and presses the leg portions together to provide the leg portions with adjacent and opposing substantially flat surface areas.

44. A method according to claim 43, wherein the groove forming member is a thermocouple.

45. A method according to claim 43, wherein the groove forming member is a mandrel, and including the step of removing the mandrel from the groove.

46. A method according to claim 43, including the step of placing the groove forming member adjacent both leg portions and forming a groove bounded at least in part by surface areas of both leg portions.

47. A method according to claim 46, including the step of disposing a sensing member in the groove, placing an outer sheath about the assembly of the heater unit and temperature sensing member and reducing the outer sheath in cross section so as to firmly retain the temperature sensing member in thermal conductive contact within the groove.

48. A method according to claim 47, including reducing the cross section of the outer sheath to provide a substantially cylindrical outer configuration for the assembled heater and temperature sensing member.

* * * * *